US010363740B2

(12) United States Patent
Mihara et al.

(10) Patent No.: US 10,363,740 B2
(45) Date of Patent: Jul. 30, 2019

(54) LIQUID EJECTION HEAD AND METHOD FOR MANUFACTURING THE SAME

(71) Applicant: CANON KABUSHIKI KAISHA, Tokyo (JP)

(72) Inventors: Hiroaki Mihara, Machida (JP); Shoji Shiba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 15/867,140

(22) Filed: Jan. 10, 2018

(65) Prior Publication Data

US 2018/0201018 A1 Jul. 19, 2018

(30) Foreign Application Priority Data

Jan. 17, 2017 (JP) ..... 2017-005896
Nov. 16, 2017 (JP) ..... 2017-220952

(51) Int. Cl.
*B41J 2/14* (2006.01)
*B41J 2/16* (2006.01)

(52) U.S. Cl.
CPC ..... *B41J 2/14145* (2013.01); *B41J 2/14201* (2013.01); *B41J 2/1603* (2013.01); *B41J 2/1607* (2013.01); *B41J 2/1628* (2013.01); *B41J 2/1631* (2013.01); *B41J 2/1639* (2013.01); *B41J 2/1645* (2013.01); *B41J 2/1648* (2013.01); *B41J 2002/14475* (2013.01); *B41J 2202/12* (2013.01)

(58) Field of Classification Search
CPC ..... B41J 2/14; B41J 2/14145; B41J 2/1648; B41J 2/1607; B41J 2/14201; B41J 2/1631; B41J 2/1639; B41J 2202/12; B41J 2/1603; B41J 2/1628; B41J 2/1645; B41J 2002/14475
See application file for complete search history.

(56) References Cited

U.S. PATENT DOCUMENTS 7,055,938 B1 6/2006 Ohkuma
2009/0278895 A1* 11/2009 Kamito ..... C09D 11/40 347/54
2014/0267497 A1* 9/2014 Takagi ..... B41J 2/14233 347/45

FOREIGN PATENT DOCUMENTS

JP 2009001003 A 1/2009
JP 2013010215 * 1/2013
KR 20080038634 * 5/2008

* cited by examiner

*Primary Examiner* — Kristal Feggins
(74) *Attorney, Agent, or Firm* — Canon U.S.A., Inc. IP Divison

(57) ABSTRACT

A liquid ejection head includes a substrate including an energy generating element configured to generate energy used for ejecting a liquid, a flow channel member overlying the substrate and defining a flow channel through which a liquid is supplied, and an ejection opening member overlying the flow channel member and defining an ejection opening through which the liquid supplied through the flow channel is ejected by the energy from the energy generating element. The flow channel member contains a crosslinked cured product of a multifunctional epoxy resin and a polyhydric alcohol having a perfluoroalkyl group in the molecular structure, and the concentration of a component derived from the polyhydric alcohol in the flow channel member is lower on the side adjacent to the substrate than on the side adjacent to the ejection opening member.

9 Claims, 6 Drawing Sheets

LIQUID EJECTION HEAD AND METHOD FOR MANUFACTURING THE SAME

BACKGROUND

Field of the Disclosure

The present disclosure relates to a liquid ejection head having enhanced durability and to a method for manufacturing the same.

Description of the Related Art

A liquid ejection head is used, for example, for printing on a printing medium with ink by an ink jet printing method or for applying a liquid, such as a surface treatment liquid, onto the surface of an object to be treated. The ink jet printing head used in the ink jet printing method performed by ejecting an ink onto a printing medium typically has very small ejection openings, a flow channel communicating with the ejection openings, and energy generating elements configured to generate energy for ejecting ink through the ejection openings. Japanese Patent Laid-Open No. 2009-1003 discloses an ink jet print head having this structure. In this prior art document, the flow channel member defining the flow channel is made of a photosensitive polyimide, a photosensitive polyamide, or a photosensitive epoxy.

U.S. Pat. No. 7,055,938 discloses a cured product of a resin composition containing a curable epoxy compound, a compound containing a fluorocarbon, and a curing agent as the material of some members of a liquid ejection head including the flow channel member. This patent document describes that the use of the cured product of the resin composition in a member of a liquid ejection head enables the liquid ejection head to eject liquid stably for a long time.

SUMMARY

The present disclosure provides a liquid ejection head that can be used for ejecting an ink or a liquid containing organic solvent with a high proportion, and that has an enhanced durability, and a method for manufacturing the liquid ejection head.

According to an aspect of the present disclosure, there is provided a liquid ejection head including a substrate including an energy generating element configured to generate energy used for ejecting liquid, a flow channel member overlying the substrate and defining a flow channel through which a liquid is supplied, and an ejection opening member overlying the flow channel member and defining an ejection opening through which the liquid supplied through the flow channel is ejected by the energy from the energy generating element.

The flow channel member contains a crosslinked cured product of a multifunctional epoxy resin and a polyhydric alcohol having a perfluoroalkyl group in the molecule thereof. In the flow channel member, a component derived from the polyhydric alcohol has a lower concentration on the side adjacent to the substrate than on the side adjacent to the ejection opening member side.

According to another aspect of the present disclosure, there is provided a method for manufacturing a liquid ejection head including a substrate including an energy generating element configured to generate energy used for ejecting liquid, a flow channel member overlying the substrate and defining a flow channel through which a liquid is supplied, and an ejection opening member overlying the flow channel member and defining an ejection opening through which the liquid supplied through the flow channel is ejected by the energy from the energy generating element. The method includes:

(1) forming a layer of a photosensitive resin composition containing a multifunctional epoxy resin and a polyhydric alcohol having a perfluoroalkyl group in the molecule thereof for the flow channel member over a substrate;

(2) forming a latent image including a flow channel pattern in the layer of the photosensitive resin composition by exposing a pattern;

(3) developing the latent image to form a flow channel;

(4) forming a layer of an ejection opening member material over the layer of the photosensitive resin composition; and (5) forming an ejection opening in the layer of the ejection opening member material to yield the ejection opening member.

The layer of the photosensitive resin composition has a first surface adjacent to the substrate and a second surface opposite the first surface, and the polyhydric alcohol in the photosensitive resin composition has a lower concentration on the side toward the first surface than on the side toward the second surface.

Further features of the present disclosure will become apparent from the following description of exemplary embodiments with reference to the attached drawings.

DESCRIPTION OF THE EMBODIMENTS

Figure 1A:
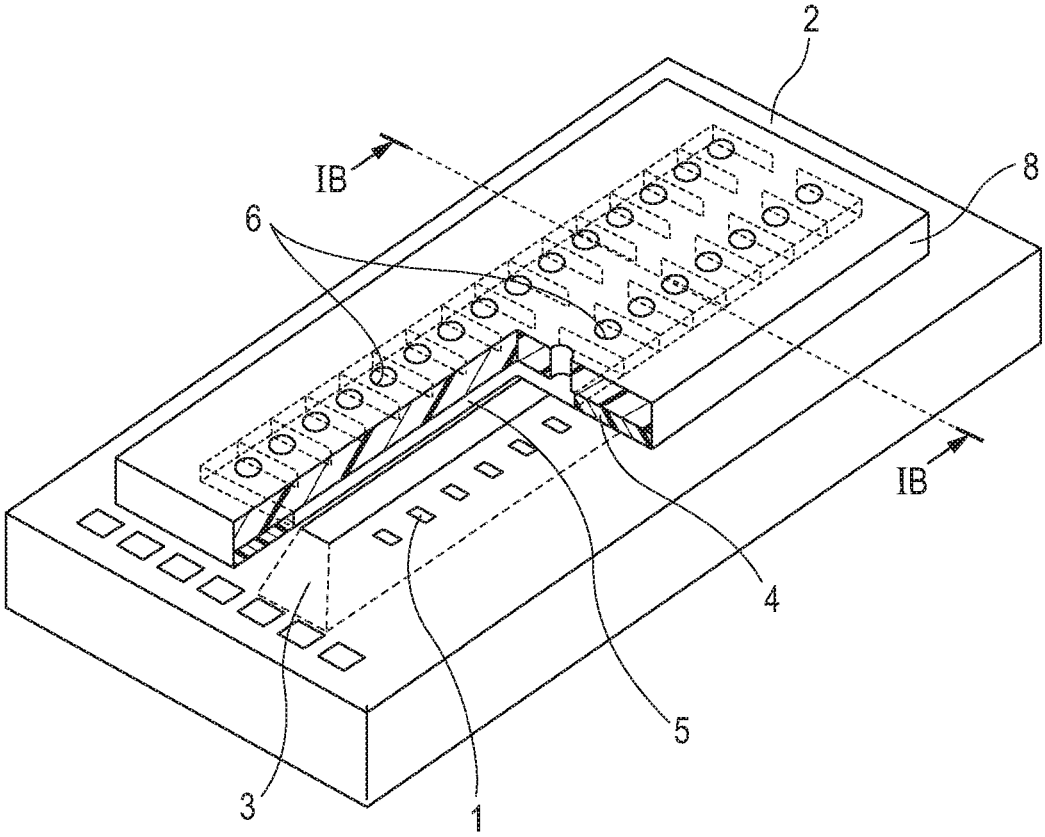
FIGS. 1A and 1B are schematic views of an ink jet printing head according to an embodiment of the present disclosure.

A variety of inks are known, including general-purpose, general home-use aqueous inks and durable, fast pigment inks for forming commercial printed articles. Also, inks are known which contains organic solvent with a higher content than general-purpose, general home-use aqueous inks so as to function as ink jet ink. There is demanded a liquid ejection head that is durable and can keep performance stably even if ink containing an organic solvent with a high proportion is used.

In the ink jet head disclosed in Japanese Patent Laid-Open No. 2009-1003, however, when an ink containing organic solvent with a high proportion is used, the flow channel member or the like is swelled. This causes the amount of ink ejection to vary, resulting in a defective printed article.

In U.S. Pat. No. 7,055,938, a resin composition containing an epoxy compound in combination with a compound containing a fluorocarbon is used for the flow channel member, and the cured product of this resin composition has a high crosslink density and exhibits a high resistance to ink and a high mechanical strength. A flow channel member made of the cured product of this resin composition does not much swell. Accordingly, a liquid ejection head including such a flow channel member can provide high performance for stable printing for a long time.

The present disclosure provides a long-life liquid ejection head that can be used even for ejecting inks and other liquid containing organic solvent with a high proportion and that exhibits an enhanced durability so as to be able to eject liquid droplets stably for a long time.

The liquid ejection head according to an embodiment of the present disclosure includes a substrate including an energy generating element configured to generate energy used for ejecting liquid, a flow channel member defining a flow channel through which a liquid is supplied, and an ejection opening member defining an ejection opening through which the liquid supplied through the flow channel is ejected by the energy from the energy generating element. The flow channel member is disposed adjacent to the substrate, and the ejection opening member is disposed adjacent to the flow channel member. In other words, the flow channel member and the ejection opening member are formed in this order on the substrate.

The flow channel member contains a crosslinked cured product of a multifunctional epoxy resin and a polyhydric alcohol having a perfluoroalkyl group in the molecular structure (hereinafter simply referred to as the polyhydric alcohol). Hence, the crosslinked cured product contains a resin component derived from the multifunctional epoxy resin and a polyhydric alcohol component derived from the polyhydric alcohol and binding to the resin component. In the flow channel member, the polyhydric alcohol component has a lower content on the side adjacent to the substrate (hereinafter referred to as the substrate side) than on the side adjacent to the ejection opening member (hereinafter referred to as the ejection opening member side). In other words, the polyhydric alcohol component in the flow channel member is distributed such that the content or concentration thereof varies in the thickness direction so as to be lower on the substrate side than on the ejection opening member side. For example, the polyhydric alcohol is distributed such that the concentration thereof in the crosslinked cured product of the flow channel member at the surface in contact with the substrate including the interface with the substrate is lower than that at the surface in contact with the ejection opening member including the interface with the ejection opening member.

By using a crosslinked cured product of a multifunctional epoxy resin and a polyhydric alcohol for forming the flow channel member, the strength and the ink resistance of the flow channel member can be further enhanced. The present inventors, however, found that when an ink or a liquid containing organic solvent with a high proportion is used, the polyhydric alcohol component in the flow channel member may adversely affect the adhesion between the flow channel member and cause the flow channel member to separate from the substrate. In the liquid ejection head of the present disclosure, the polyhydric alcohol component is distributed such that the concentration of the polyhydric alcohol component varies in the thickness direction of the flow channel member. Consequently, the crosslinked cured structure makes the entire flow channel member resistant to ink and enhances the adhesion strength between the substrate and the flow channel member. Thus, the durability of the liquid ejection head is further increased.

The degree of the concentration distribution of the polyhydric alcohol component in the thickness direction of the flow channel member is not particularly limited as long as advantageous effects are produced. In an embodiment, the concentration of the polyhydric alcohol component in the flow channel member on the substrate side may be in the range of 0.1% by mass to 20% by mass, such as in the range of 0.1% by mass to 10% by mass, and the concentration of the polyhydric alcohol on the ejection opening side may be in the range of 5% by mass to 30% by mass, such as in the range of 10% by mass to 25% by mass.

The content or concentration of the polyhydric alcohol component in the flow channel member can be obtained by determining the peaks derived from the polyhydric alcohol in the flow channel member, such as the peaks of perfluoroalkyl groups, with an infrared spectrophotometer (IR). More specifically, the determination results of detected peaks are converted into the mass of the polyhydric alcohol, and the mass is divided by the mass of the entire flow channel member.

An IR measurement will be described below. For obtaining an IR spectrum, an attenuated total reflection (ATR) method is applied. The ATR method can provide information of the measuring object generally from the uppermost surface to a depth of 1 μm. Accordingly, the concentration or content of the polyhydric alcohol component on the substrate side or on the ejection opening member side, mentioned herein is the concentration or content in the region of the flow channel member from the surface adjacent to the substrate or the surface adjacent to the ejection opening member to a depth of 1 μm.

The liquid ejection head may be used as an ink jet printing head, for example, for printing letters and characters, images, and patterns or for dyeing. The liquid ejection head may also be used for applying a variety of surface treatment liquids onto a surface to be treated by an ink jet method.

Figure 1B:
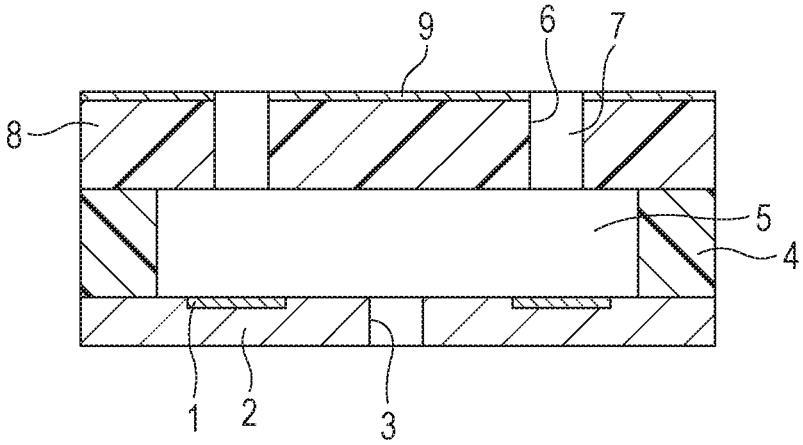

An embodiment of the present disclosure will now be described with reference to the drawings. FIG. 1A is a schematic perspective view in partial section of the liquid ejection head according to an embodiment of the present disclosure. FIG. 1B is a schematic fragmentary sectional view of the liquid ejection head taken along line IB-IB shown in FIG. 1A.

The liquid ejection head shown in FIGS. 1A and 1B includes a substrate 2 including energy generating elements 1 configured to generate energy used for ejecting ink. The energy generating elements are arranged at regular intervals. The energy generating element 1 may be an electrothermal conversion element, such as a heater, or a piezoelectric element. The substrate 2 has an ink supply port 3 through which an ink is supplied. The substrate 2 is made of an inorganic material. Examples of the inorganic material include silicon, silicon carbide, silicon nitride, glass (quartz glass, borosilicate glass, non-alkali glass, soda glass), alumina, gallium arsenide, gallium nitride, aluminum nitride, and aluminum alloys. A silicon substrate is generally used as the substrate 2. The substrate 2 is provided with a wiring layer used for driving the energy generating elements 1, an insulating layer made of an inorganic material such as $SiO_2$ or SiN, and a protective layer at the surface thereof. A flow channel member 4 overlies the substrate 2 and defines side walls of a flow channel 5. Furthermore, an ejection opening member 8 having ejection openings 6 and ejection portions 7 that are through holes communicating between each flow channel 5 and the corresponding ejection opening 6 is disposed over at least the flow channel 5 of the flow channel member 4. In addition, a liquid-repellent layer 9 may optionally be disposed over the ejection opening member 8. The substrate 2 may be in direct contact with the flow channel member 4, or a layer of a resin material, such as polyether amide, may be disposed between the substrate 2 and the flow channel member 4 for enhancing adhesion.

The thicknesses of the flow channel member 4 and the ejection opening member 8 may be determined according to the ejection design. The thickness of the flow channel member 4 may be in the range of 3 μm to 25 μm. The thickness of the ejection opening member 8 may be in the range of 1 μm to 25 μm.

In the liquid ejection head, the liquid, such as ink, fed into the flow channel 5 through the supply port 3 is ejected as ink droplets from the ejection openings 6 through the respective ejection portions 7 by applying a pressure generated by the energy generating elements 1 to the liquid.

The flow channel 5 may be referred to as a pressure chamber. The pressure chamber is the region between the energy generating elements 1 and the ejection openings 7 of the space in which the liquid flows, and the region in which a pressure is actually placed on the ink for ejecting the ink. If, for example, the energy generating elements 1 are electrothermal conversion elements, at least the region in which air bubbles are grown by heat applied from the electrothermal conversion elements is the pressure chamber.

Figure 2:
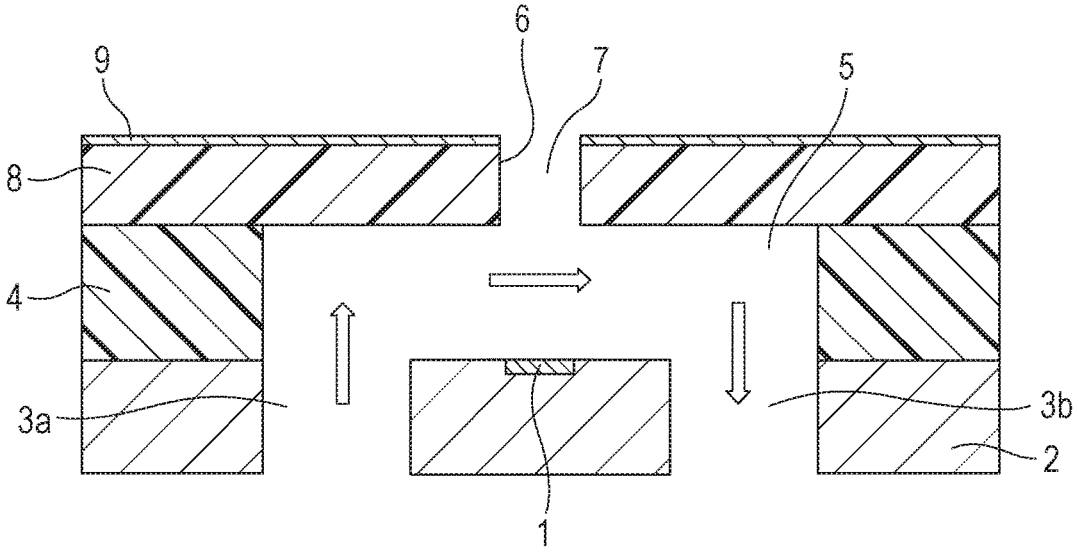
FIG. 2 is a schematic view of an ink jet printing head according to another embodiment of the present disclosure.

FIG. 2 is a fragmentary schematic sectional view of the liquid ejection head according to another embodiment of the present disclosure. As with the liquid ejection head shown in FIGS. 1A and 1B, the liquid ejection head shown in FIG. 2 includes a substrate 2 including energy generating elements 1, a flow channel member 4 having a flow channel 5, and an ejection opening member 8 having ejection openings 6. In this liquid ejection head shown in FIG. 2, the single flow channel 5 communicates with two supply ports 3*a* and 3*b* through which liquid may be circulated between the inside of the flow channel (pressure chamber) 5 and the outside of the flow channel 5. More specifically, the liquid may be passed to the flow channel 5 through the left supply port 3*a* and discharged through the right supply port 3*b*, as designated by the arrows in FIG. 2. If the liquid ejection head is incorporated into an ink jet printing head, this liquid flow hinders the ink in the ejection openings 6 and the flow channel 5 from becoming sticky.

In the liquid ejection head allowing the liquid to circulate between the flow channel 5 and the outside as in the present embodiment just described, the flow channel member 4 is in contact with flowing liquid for a long time. This is likely to cause the flow channel member 4 to swell compared with the case where liquid is not circulated. Accordingly, it is beneficial in terms of enhancing the strength and resistance to ink of the flow channel member 4 that the flow channel member 4 of the liquid ejection head of the foregoing embodiment contains the above-described polyhydric alcohol component. When the polyhydric alcohol component is added to the flow channel member 4, a concentration distribution of the polyhydric alcohol component is formed in the flow channel member 4 such that the concentration is lower on the substrate side than on the ejection opening member side, thereby increasing the strength of the adhesion between the substrate 1 and the flow channel member 4.

A method for manufacturing the liquid ejecting head, according to an embodiment of the present disclosure will now be described.

The method includes the following steps:

(1) forming a layer of a photosensitive resin composition containing a multifunctional epoxy resin and a polyhydric alcohol for a flow channel member on a substrate;

(2) forming a latent image including a flow channel pattern in the layer of the photosensitive resin composition by exposing a pattern;

(3) developing the latent image to form a flow channel;

(4) forming a layer of an ejection opening member material for the flow channel member on the layer of the photosensitive resin composition; and (5) forming an ejection opening in the layer of the ejection opening member material to yield the ejection opening member.

The layer of the photosensitive resin composition has a first surface adjacent to the substrate and a second surface opposite the first surface and has a concentration distribution in the thickness direction in which the concentration of the polyhydric alcohol on the first surface side is lower than that on the second surface side.

Any method may be applied to step (1) as long as a distribution in which the concentration of the polyhydric alcohol varies in the thickness direction as desired can be formed in the layer of the photosensitive resin composition that is the material for forming the flow channel member. Any of the following method may be applied to step (1):

(I) At least two layers of photosensitive resin compositions containing a multifunctional epoxy resin and a polyhydric alcohol and having different polyhydric alcohol contents are formed over the substrate in order of increasing polyhydric alcohol concentration.

(II) A layer of a resin composition containing a multifunctional epoxy resin and a polyhydric alcohol is heat-treated so as to vary the concentration of the polyhydric alcohol in the thickness direction, and the heat-treated layer is laminated onto the substrate as the layer of the photosensitive resin composition for the flow channel member.

(III) A dry film having a concentration distribution of the polyhydric alcohol is transferred to the substrate.

In method (I), dry films may be used as the layers of photosensitive resin compositions. Forming a concentration distribution of the polyhydric alcohol, which is the feature of the present disclosure, is beneficial for enhancing the adhesion between the layer of the photosensitive resin composition and the substrate when a dry film of the photosensitive resin composition is transferred onto the substrate. This is because a layer of the photosensitive resin composition laminated on the substrate by transferring a dry film of the photosensitive resin composition is less compatible with the substrate and less adhesive to the substrate than a layer formed by any other method such as the method (coating) of applying a liquid of the photosensitive resin composition onto the substrate. The method using a dry film is advantageous for forming a uniform layer over an uneven surface of a substrate having a supply port and other through holes compared with the case using the coating method.

The method (III) of transferring a dry film may include the following steps (1-1) to (1-3):

(1-1) forming a dry film by applying a photosensitive resin composition containing a multifunctional epoxy resin and a polyhydric alcohol onto a base;

(1-2) forming a concentration distribution of the polyhydric alcohol in the thickness direction in the dry film so that the polyhydric alcohol concentration on the side toward the surface (second surface) of the dry film adjacent to the base can be higher than that on the opposite side, that is, the side toward the surface (first surface) opposite the base; and (1-3) transferring the dry film having the concentration distribution of the polyhydric alcohol to the substrate of the liquid ejection head so that the second surface of the dry film is exposed to the outside, thus forming the layer of the photosensitive resin composition of the flow channel member.

Steps (1-1) and (1-2) may be two independent steps or at least part of them may be performed at one time as the same operation.

Any method may be applied to step (1-2) as long as a distribution in which the concentration of the polyhydric alcohol varies in the thickness direction as desired can be formed in the layer of the photosensitive resin composition that is the material for forming the flow channel member. Any of the following method may be applied to step (1-2):

(i) At least two layers of photosensitive resin compositions for dry films, containing a multilayer epoxy resin and a polyhydric alcohol and having different polyhydric alcohol contents are formed on a base in order of decreasing polyhydric alcohol concentration, and the layers are turned into dry films.

(ii) At least two dry films containing a multilayer epoxy resin and a polyhydric alcohol and having different polyhydric alcohol contents are laminated on a base in order of decreasing polyhydric alcohol concentration, thus forming a multilayer dry film.

(iii) A layer of a photosensitive resin composition containing a multifunctional epoxy resin and a polyhydric alcohol formed on a base is heat-treated.

In methods (i) and (ii), steps (1-1) and (1-2) are simultaneously performed. The heat treatment of method (iii) may be performed after the dry film has been formed on the base, or may be performed simultaneously with the formation of the dry film as in the Examples described herein below.

The heat treatment of method (iii) causes the volatile polyhydric alcohol to evaporate at a heat treatment temperature from the dry film through the second surface (surface exposed to the outside) that is exposed to a gas phase such as air opposite the first surface adjacent to the substrate. The amount of evaporated polyhydric alcohol decreases with increasing depth toward the substrate. Thus, the dry film has a concentration distribution in which the concentration of the polyhydric alcohol decreases in the direction toward the substrate. If this dry film is transferred to the substrate of the liquid ejection head in step (1-3), the second surface of the dry film, at which the polyhydric alcohol concentration is low, comes into contact with the substrate to define the interface with the substrate, and the opposite surface or first surface, which has been in contact with the base, becomes the outer surface on which the ejection opening member will be formed. Through these steps, the crosslinked cured product of the flow channel member has a concentration distribution of the polyhydric alcohol in which the concentration of polyhydric alcohol component on the substrate side is lower than that on the ejection opening member side.

In the concentration distribution of the polyhydric alcohol in the thickness direction, formed by the heat treatment of method (iii), the polyhydric alcohol concentration is lowest at the surface opposite the base and increases gradually toward the base; hence, this distribution generally has no local maximum. The polyhydric alcohol concentration may reach the maximum at a position, inward from the exposed surface of the dry film opposite the base, at which the dry film can have an intended adhesion strength with the substrate of the liquid ejection head. The maximum value of the polyhydric alcohol concentration in the thickness direction of the dry film may be kept from this maximum position to the interface with the base.

For forming such a concentration distribution of the polyhydric alcohol in the thickness direction by method (iii), it is desirable that the base be made of a material not permeable to polyhydric alcohol.

Method (iii) facilitates easy formation of a concentration distribution of the polyhydric alcohol.

Steps (2) to (5) may be performed in any order without particular limitation, and the order of the steps may be changed from the viewpoint of forming the intended structure in which a flow channel member and an ejection opening member are disposed over a substrate. The exposure for forming the latent image in step (2) may be performed before step (4) or after step (4). Step (3) may be performed as a part of step (5) or may be performed after step (5).

If a dry film has been transferred as the material for forming the flow channel member to the substrate, steps (2) to (5) may be performed by a combination of steps (2A) to (5A) or steps (2B) to (5B).

Combination of Steps (2A) to (5A):

(2A) forming a latent image including a flow channel pattern in a dry film transferred to the substrate by exposing a pattern;

(3A) forming a layer of a photosensitive composition for the ejection opening member on the dry film to cover at least the latent image including the flow channel pattern;

(4A) forming an ejection opening in the layer of the photosensitive composition for the ejection opening member to yield the ejection opening member; and (5A) developing the latent image including the flow channel pattern to form a flow channel Combination of Steps (2B) to (5B):

(2B) forming a layer of a photosensitive resin composition for the ejection opening member on the dry film transferred to the substrate, thus forming a multilayer structure;

(3B) forming a latent image including a flow channel pattern in the multilayer structure by exposing a pattern;

(4B) forming a latent image including an ejection opening pattern in the multilayer structure by exposing a pattern; and (5B) developing the latent image including the flow channel pattern and the latent image including the ejection opening pattern to form a flow channel and an ejection opening.

For the latent image including the flow channel pattern or the latent image including the ejection opening pattern, if the photosensitive resin composition has a negative photosensitivity, the flow channel or the ejection opening is formed in the unexposed portion.

A first embodiment of the method for manufacturing a liquid ejection head of the present disclosure will now be described.

FIGS. 3A to 3E and FIGS. 6A to 6C are schematic sectional views illustrating a method for manufacturing a liquid ejection head, according to an embodiment of the present disclosure, and show the section at the same position as the sectional view of the finished form shown in FIG. 1B. The method according to the first embodiment will be described step by step with reference to the drawings.

Figure 6A:
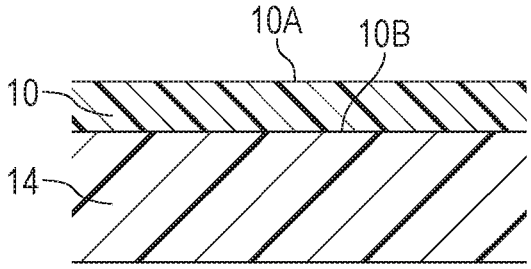
FIG. 6A to 6C are representations of a method for manufacturing an ink jet printing head, according to an embodiment of the present disclosure.
Figure 6B:
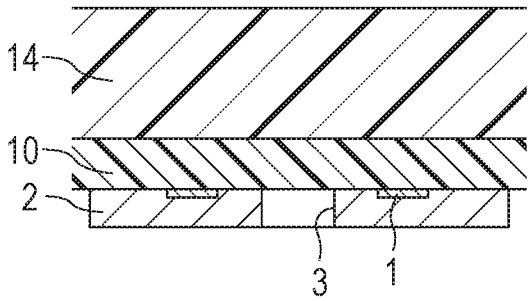
Figure 6C:
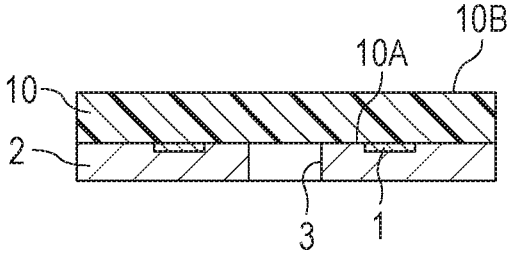

Preparation and Heat Treatment of Dry Film (FIGS. 6A to 6C)

Referring now to FIGS. 6A to 6C, a dry film (hereinafter abbreviate to DF) 10 is formed by applying photosensitive resin composition (1) dissolved in a solvent onto a base film 14 made of polyethylene terephthalate (PET), polyimide, or the like. In the present embodiment, photosensitive resin composition (1) for forming the DF is a negative type.

Photosensitive resin composition (1) contains a multifunctional epoxy resin, a swelling inhibitor, and a photo-acid generator. These constituents of the photosensitive resin composition will be described in detail below.

Multifunctional Epoxy Resin

Examples of the multifunctional epoxy resin include phenol novolac epoxy resin, cresol novolac epoxy resin, bisphenol A novolac epoxy resin, multifunctional epoxy resin having an oxycyclohexane skeleton. Trifunctional or higher functional epoxy resin is beneficial. The foregoing epoxy resins may be used single or in combination. A commercially available epoxy resin may be used, and examples thereof include EHPE 3150 (produced by Daicel), 157S70 and jER1031S (each produced by Mitsubishi Chemical), and EPICLON N-865 and EPICLON N-695 (each produced by DIC).

Swelling Inhibiter

A polyhydric alcohol is used as the swelling inhibitor. The polyhydric alcohol has a perfluoroalkyl group in the molecular structure there thereof. The perfluoroalkyl group is effective in hindering the water and the solvent in the ink from penetrating the resin. The hydroxy group of the polyhydric alcohol has an affinity with the multifunctional epoxy resin and binds chemically with the epoxy group during the ring-opening polymerization of the epoxy, thus functioning as a crosslinking agent for forming a strong crosslinked cured product. It is therefore desirable that the polyhydric alcohol has two or more hydroxy groups in the molecule.

If a distribution in which the concentration of the swelling inhibitor varies gradually in the thickness direction of the dry film is formed by heat treatment of the DF, which will be described herein later, the swelling inhibitor is desirably volatile or sublimable. If the DF is heat-treated at a temperature in the range of 90° C. to 140° C. (described herein later in detail) and the swelling inhibitor has a boiling point, the boiling point of the selling inhibitor is beneficially in the range of 90° C. to 450° C.

The weight average molecular weight of the swelling inhibitor may be in the range of from 200 to 500. More specifically, any of the following compounds may be used as the swelling inhibitor.

(1)

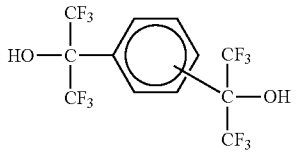

(2)

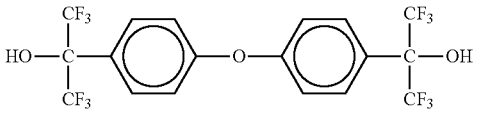

(3)

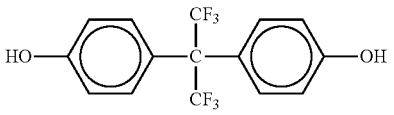

(4)

In formula (4), n represents an integer in the range of 1 to 20.

Also, the swelling inhibitor may have two trifluoromethyl groups and one or two phenyl groups and/or one or two phenylene groups from the viewpoint of imparting the intended properties.

The compounds represented by the above formulas (1) to (3) are beneficial as the swelling inhibitor. The swelling inhibitor is commercially available, and examples thereof include 1,4-HFAB, 1,3-HFAB, and BIS-AF (each produced by Central Glass). These swelling inhibitors may be used single or in combination.

Photo-Acid Generator

The photo-acid generator may be selected from among sulfonic acid compounds, sulfonium salts, iodonium salts, disulfone-based compounds, and phosphoric acid compounds. A commercially available photo-acid generator may be used, and example thereof include ADEKA Optomer SP-170, ADEKA Optomer SP-172, and ADEKA Optomer SP-150 (each produced by ADEKA); BBI-103 and BBI-102 (each produced by Midori Kagaku); IBPF, IBCF, TS-01, and TS-91 (each produced by Sanwa Chemical); CPI-210, CPI-300, and CPI-410 (each produced by San-Apro); and Irgacure 290 (produced by BASF). A mixture of two or more of these photo-acid generators may be used.

Other Ingredients

Photosensitive resin composition (1) may further contain a silane coupling agent in order to enhance the adhesion with the adjacent flow channel member. The silane coupling agent is commercially available, and, for example, A-187 produced by Momentive Performance Materials may be used.

Photosensitive resin composition (1) may also contain a sensitizer, such as anthracene compound, for increasing pattern resolution and controlling sensitivity (the amount of exposure required for curing), and a cation trapping agent, such as an amine or any other basic substance or an acid generator capable of producing weakly acidic (pKa=−1.5 to 3.0) toluenesulfonic acid. Commercially available acid generators include TPS-1000 produced by Midori Kagaku or WPAG-367 produced by Wako Pure Chemical Industries.

The constituents and contents thereof in photosensitive resin composition (1) are not otherwise limited as long as the composition can have a desired photosensitivity and provide properties required of the flow channel member.

Next, the DF 10 formed of photosensitive resin composition (1) is heat-treated to remove part of the swelling inhibitor from the DF 10. If the swelling inhibitor is a composition capable of volatilizing (sublimating) at a relatively low temperature, a distribution in which the swelling inhibitor concentration decreased gradually in the thickness direction from the second surface 10B adjacent to the base film 14 to the opposite first surface 10A (outer surface of the DF) can be formed in the DF 10 by heat-treating the DF 10 during or after the formation of the DF. This heat treatment is performed under conditions including temperature and time so that the concentration distribution can have a desired gradient. If the heat treatment temperature is excessively low, the volatilization takes a long time; if the heat treatment temperature is excessively high, the volatilization is difficult to control. Accordingly, the heat treatment may be performed at a temperature in the range of 90° C. to 140° C. To accelerate the volatilization, the heat treatment may be performed under reduced pressure.

The swelling inhibitor content in the composition is determined so that the resulting cured product can have intended properties according to the concentration distribution in the thickness direction. If the proportion of the swelling inhibitor to the multifunctional epoxy resin is excessively low, however, the effect of the swelling inhibitor may be insufficient. In contrast, if the proportion of the swelling inhibitor is excessively high, the density of crosslinks between epoxy groups is reduced. Accordingly, if the liquid ejection head is used for ejecting an ink or the like containing organic solvent with a high proportion, the adhesion between the substrate and the ejection opening member (described herein later) may be reduced, for example. Beneficially, the proportion of the swelling inhibitor to 100 parts by mass of the multifunctional epoxy resin is in the range of 10 parts by mass to 40 parts by mass and is more beneficially in the range of 15 parts by mass to 40 parts by mass, such as in the range of 15 parts by mass to 30 parts by mass.

The concentration distribution of the polyhydric alcohol between the surface adjacent to the base and the opposite exposed surface formed by the heat treatment is not much varied by exposure of the DF and post exposure bake (PEB) that will be described herein later. Accordingly, it may be the same as the concentration distribution of the polyhydric alcohol component in the flow channel member described above as an embodiment. More specifically, the concentration of the polyhydric alcohol at the exposed surface may be in the range of 0.1% by mass to 20% by mass, such as 0.1% by mass to 10% by mass, and that at the surface adjacent to the base may be in the range of 5% by mass to 30% by mass, such as 10% by mass to 25% by mass.

As an alternative to the heat treatment, two or more layers containing polyhydric alcohol with different contents may be used to form a concentration distribution of the polyhydric alcohol in the thickness direction, as described above.

The polyhydric alcohol content in the DF may be measured in the same manner as the measurement of the polyhydric alcohol component in the flow channel member. For example, the content or concentration of the polyhydric alcohol in the DF can be obtained by measuring the surface of the DF and determining the peaks of the hydroxy group and perfluoroalkyl groups with an infrared spectrophotometer (IR) before and after the heat treatment. For measuring the gradient of the changes in concentration in the DF, the DF may be cut diagonally after the heat treatment and subjected to IR analysis for line analysis of the peaks.

Figure 3A:
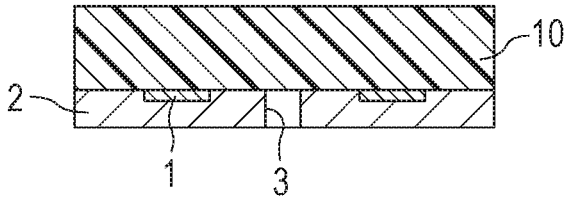
FIG. 3A to 3E are representations of a method for manufacturing an ink jet printing head, according to an embodiment of the present disclosure.

Lamination (FIGS. 3A and 6C)

The DF 10 having the concentration distribution of the polyhydric alcohol in the thickness direction is transferred onto the substrate 2 including the energy generating elements 1 and having the supply port 3 by lamination.

In photosensitive resin composition (1) in the DF 10, the concentration of the swelling inhibitor is higher at the second surface 10B adjacent to the base film 14 than at the first surface 10A or outer surface. However, after the lamination onto the substrate 2, as shown in FIG. 6C, the concentration of the swelling inhibitor at the first surface 10A adjacent to the substrate 2 is lower than that at the second surface 10B or outer surface. In the finished liquid ejection head, the concentration of the swelling inhibitor at the first surface 10A of flow channel member 4 adjacent to the substrate 2 is thus relatively low. Accordingly, there is no fear of reducing the adhesion between the substrate 2 and the flow channel member 4 in which the flow channel 5 is formed. The swelling inhibitor has a sufficient concentration at the second surface 10B adjacent to the ejection opening member 8 in which the ejection openings 6 and the ejection portions 7 will be formed. Accordingly, the flow channel member 4 is kept from being swelled by liquid such as ink.

The DF 10 may be laminated onto the substrate 2 that is being heated from the viewpoint of ensuring a sufficient adhesion between the DF 10 and the substrate 2. By the lamination of the DF 10 while the substrate 2 is being heated, the adhesion between the substrate 2 and the flow channel member 4 of the finished liquid ejection head can be enhanced. Desirably, the temperature at which the substrate 2 is heated during lamination is relatively low so as not to vary greatly the polyhydric alcohol concentration in the DF 10. More specifically, the heating temperature may be in the range of 30° C. to 100° C., such as 40° C. to 90° C.

Figure 3B:
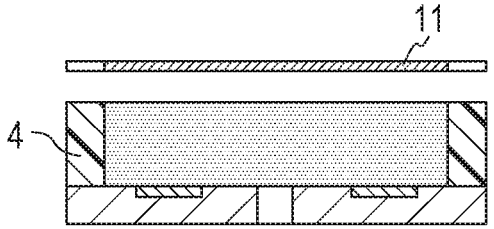

Exposure of Flow Channel Pattern (FIG. 3B)

Next, the DF 10 covered with a mask 11 having a flow channel pattern is exposed to light to form a latent image including an exposed portion and an unexposed portion and is then further subjected to heat treatment (Post Exposure Bake, hereinafter abbreviated as PEB) to cure the exposed portion, thus forming the flow channel member 4. The unexposed portion having the flow channel pattern remains in this stage and will be removed by development.

The mask 11 is a plate made of a material capable of transmitting exposure light, such as glass or quartz, and covered with a light-shielding film, such as a chrome film, having the flow channel pattern. The exposure apparatus may include a single wavelength light source, such as i-line exposure stepper or a KrF stepper, or may be a projection exposure apparatus including a light source having a broad wavelength range of a mercury lamp, such as Mask Aligner MPA-600 Super (manufactured by Canon).

The PEB conditions are not particularly limited as long as a desired pattern can be formed. The PEB may be performed, for example, at a temperature in the range of 40° C. to 110° C. for 3 minutes to 10 minutes. Beneficially, the PEB temperature is in the range of 40° C. to 90° C., more beneficially in the range of 50° C. to 80° C., so as not to vary greatly the polyhydric alcohol content in the DF 10.

Figure 3C:
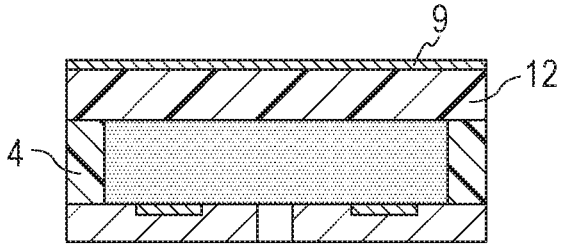

Formation of Layer of Ejection Opening Member (FIG. 3C)

Next, a DF 12 is formed of photosensitive resin composition (2) in the same manner as in the above-described DF 10 and is then transferred onto the DF 10 including the latent image by lamination. In the present embodiment, a negative photosensitive resin composition is used for forming the DF 12. The lamination of the DF 12 may be performed while the substrate 2 is being heated, as in the lamination of the DF 10.

A liquid-repellent layer 9 may further be formed over the DF 12, if necessary. The liquid-repellent layer 9 is repellent to ink or any other liquid to be ejected. If an aqueous ink is ejected from the liquid ejection head, a cationically polymerizable perfluoroalkyl composition or perfluoroalkyl polyether composition may be used.

The cured product of the photosensitive resin composition (2) is required to have a mechanical strength and, further, a resolution as a lithography material sufficient to form fine ejection openings. Accordingly, photosensitive resin composition (2) beneficially contains a negative epoxy resin, such as bisphenol A novolac epoxy resin, phenol novolac epoxy resin, cresol novolac epoxy resin, or trifunctional or higher functional epoxy resin having an oxycyclohexane skeleton, as the base material. These epoxy resins may be used single or in combination. Constituents of photosensitive resin composition (2) will be described in detail below.

Epoxy Resin

The use of a trifunctional or higher functional epoxy resin enables the cured product to have three-dimensional cross-links and helps impart desired properties to the cured product. The epoxy resin is commercially available, and examples thereof include Celloxide 2021, GT-300 series, GT-400 series, and EHPE 3150 (each produced by Daicel); 157S70 (produced by Mitsubishi Chemical Corporation); and EPICLON N-695 and EPICLON N-865 (each produced by DIC Corporation). These epoxy resins may be used single or in combination.

Photopolymerization Initiators

A photopolymerization initiator may be added for curing the epoxy resin composition, and any of the photo-acid generators cited for photosensitive resin composition (1) may be used. In the method of the present disclosure, it is beneficial that photosensitive resin composition (2) is more sensitive than photosensitive resin composition (1), and the constituents and the proportions thereof may be controlled so as to have a desired sensitivity.

Swelling Inhibiter

As with photosensitive resin composition (1), photosensitive resin composition (2) may contain a swelling inhibitor. The swelling inhibitor may be the same polyhydric alcohol having a perfluoroalkyl group as used in photosensitive resin composition (1). However, the concentration of the swelling inhibitor in the DF 12 in the thickness direction is desirably constant. Accordingly, removal of the solvent for forming the DF 12 is performed desirably at a temperature of 90° C. or less.

The content of the polyhydric alcohol, or swelling inhibitor, in photosensitive resin composition (2) may be in the range of 0% by mass to 30% by mass and is beneficially in the range of 0% by mass to 20% by mass.

Other Ingredients

Photosensitive resin composition (2) may further contain other additives as with photosensitive resin composition (1), and a sensitizer, such as an anthracene compound, may be added from the viewpoint of increasing the sensitivity to a level higher than photosensitive resin composition (1). For example, a commercially available sensitizer ADEKA Optomer SP-100 produced by ADEKA may be used.

The constituents and contents thereof in photosensitive resin composition (2) are not otherwise limited as long as the composition can have a desired photosensitivity and provide properties required of the flow channel member.

Figure 3D:
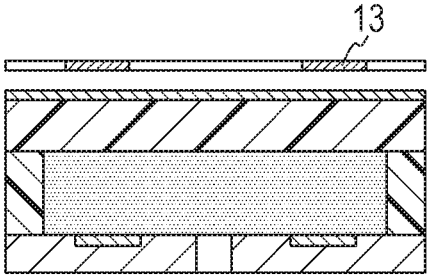

Exposure of Ejection Opening Pattern (FIG. 3D)

Next, the DF 12 and the liquid-repellent layer 9 are exposed through a mask 13 having an ejection opening pattern to form a latent image including an exposed portion and an unexposed portion. Furthermore, the exposed DF 12 and liquid-repellent layer 9 are subjected to PEB to cure the exposed portion, thus forming the ejection opening member 8. The unexposed portion having the pattern for the ejection opening 6 and ejection portion 7 remains in this stage and will be removed by development.

The exposure apparatus may be the same as used in the exposure of photosensitive resin composition (1).

Figure 4A:
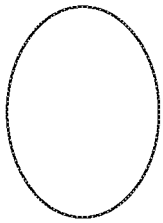
FIGS. 4A to 4C are schematic views of exemplary shapes of the ejection openings of an ink jet printing head according to an embodiment of the present disclosure.
Figure 4B:
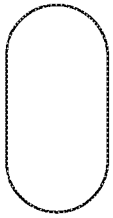
Figure 4C:
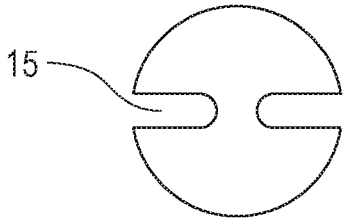

In the present embodiment, the amount of exposure for curing photosensitive resin composition (2) to form the DF 12 is lower than that for curing photosensitive resin composition (1) to form the DF 10. If the amount of exposure of photosensitive resin composition (2) to form the DF 12 is so high as the light transmitted through the DF 12 cures the DF 10, the unexposed portion of the DF 10 becomes difficult to remove, and the flow channel 5 cannot be formed. Accordingly, photosensitive resin composition (2) is more sensitive to light than photosensitive resin composition (1). The difference in photosensitivity between the photosensitive resin compositions can be controlled by changing the types of resin and photopolymerization initiator or varying the proportions thereof. The portion of the ejection opening pattern defining the ejection opening is not necessarily circular and may be in any shape including the shapes shown in FIGS. 4A to 4C. An ejection opening in the shape having protrusions 15 as shown in FIG. 4C can hold liquid between the protrusions 15 and reduce the phenomenon in which ink droplets are divided into main droplets and satellites when ink is ejected, thus helping high quality printing.

Figure 3E:
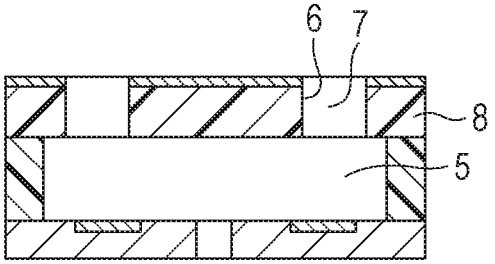

Development (FIG. 3E)

Next, the DF 10 and DF 12, each including the latent image, and the liquid-repellent layer 9 are developed with an organic solvent to remove the uncured portions, thus forming the flow channel 5, the ejection openings 6, and the ejection portions 7. Furthermore, the flow channel member 4, the ejection opening member 8, and the liquid-repellent layer 9 are heat-treated, as required, to promote crosslinking reactions, and thus, the liquid ejection head is completed.

Although, in the method just described, the DF 12 is laminated after the DF 10 has been exposed, the DF 12 may be laminated before the exposure of the DF 10 in another embodiment. FIGS. 5A to 5E illustrate such a process.

FIGS. 5A to 5E are schematic sectional views illustrating a method for manufacturing a liquid ejection head, according to a second embodiment of the present disclosure and show the section at the same position as the sectional view of the finished form shown in FIG. 1B. The DF's are formed in the same manner as described in the first embodiment.

Figure 5A:
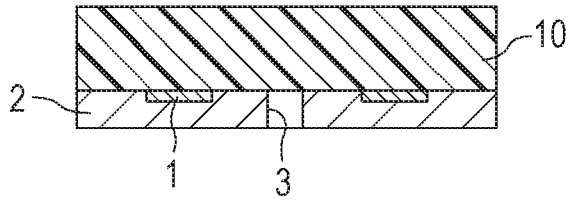
FIG. 5A to 5E are representations of a method for manufacturing an ink jet printing head, according to an embodiment of the present disclosure.

First, the DF 10 is formed of photosensitive resin composition (1) and is then transferred onto the substrate 2 including the energy generating element 1 and having the supply port 3 by lamination (FIG. 5A).

Figure 5B:
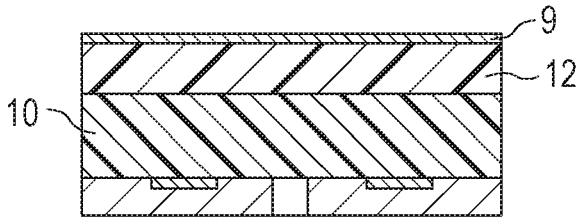

Subsequently, the DF 12 is formed of photosensitive resin composition (2) and is then transferred onto the DF 10 by lamination to form a multilayer structure including the DF 10 and the DF 12. The liquid-repellent layer 9 may optionally be formed on the DF 12 (FIG. 5B).

Figure 5C:
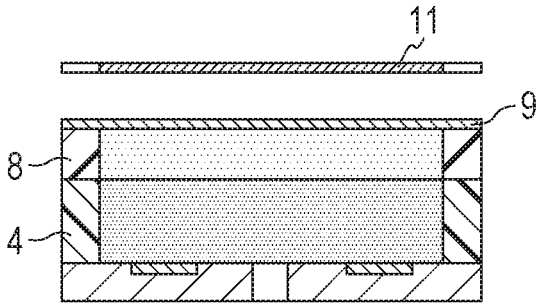

Then, photosensitive resin composition (1) in the DF 10 and photosensitive resin composition (2) in the DF 12 of the multilayer structure are exposed through a mask 11 having a flow channel pattern to form a latent image including an exposed portion and an unexposed portion. The exposed multilayer structure is subjected to PEB to cure the exposed portion, thus forming the flow channel member 4 and part of the ejection opening member 8 (FIG. 5C).

Figure 5D:
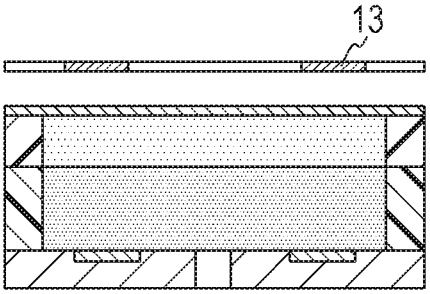

Subsequently, the DF 12 of the multilayer structure and the liquid-repellent layer 9 are exposed through a mask 13 having an ejection opening pattern to form a latent image including an exposed portion and an unexposed portion. The exposed DF 12 and liquid-repellent layer 9 are further subjected to PEB to cure the exposed portion, thus forming the ejection opening member 8 (FIG. 5D). However, the exposure of the ejection opening pattern may be performed before the exposure of the flow channel pattern.

Figure 5E:
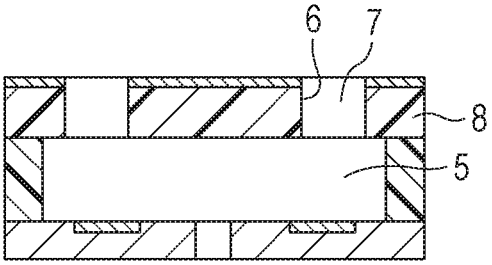

Next, the DF 10, the DF 12, and the liquid-repellent layer 9 are developed with an organic solvent to remove the uncured portions, thus forming the flow channel 5, the ejection openings 6, and the ejection portions 7. The liquid ejection head is thus completed (FIG. 5E).

In the embodiments shown in FIGS. 3A to 3E and 5A to 5E, the supply port 3 is formed in the substrate 2 before the lamination of the DF 10. However, the timing when the supply port 3 is formed in the substrate 2 is not limited to these embodiments. For example, the supply port 3 may be formed in the substrate 2 after the completion of the step shown in FIG. 3D or 5D so as to be used as a passage for removing the unexposed portion by development.

EXAMPLES

The subject matter of the present disclosure will be further described in detail with reference to the following Examples, which are not intended to limit the disclosure.

Examples 1 to 22

Swelling inhibitors added to photosensitive resin composition (1) and the amounts thereof, baking conditions for forming the DF, and test results of the liquid ejection heads produced under the conditions are shown together in Table 1. The liquid ejection head of each Example was produced in the process shown in FIGS. 6A to 6C and FIGS. 3A to 3E.

First, a solution of photosensitive resin composition (1) was applied onto a base film (base) 14 and baked to form a 15 μm-thick DF 10 of photosensitive resin composition (1), as shown in FIG. 6A. A 100 μm-thick PET film was used as the base film 14. The solution of photosensitive resin composition (1) contained the following materials:

multifunctional epoxy resin EPICLON N-695 (produced by DIC): 100 parts by mass

CPI-210 (produced by San-Apro): 0.5 part by mass

A-187 (produced by Momentive Performance Materials): 5 parts by mass swelling inhibitor shown in Table 1: with a proportion shown in Table 1 relative to 100 parts by mass of multifunctional epoxy resin propylene glycol monomethyl ether acetate: 120 parts by mass The names of the swelling inhibitors shown in Table 1 are abbreviates of the following compounds: 1,4-HFAB: 1,4-bis(2-hydroxyhexafluoroisopropyl)benzene 1,3-HFAB: 1,3-bis(2-hydroxyhexafluoroisopropyl)benzene BIS-AF: 2,2-bis(4-hydroxyhenyl)hexafluoropropyl The "base side" shown in Table 1 refers to the surface of the DF adjacent to the base film.

When the solution of photosensitive resin composition (1) applied onto the base film 14 was baked, part of the swelling inhibitor was removed simultaneously with the evaporation of the solvent.

Baking conditions (temperature and time); and

Concentration of the swelling inhibitor after baking (at the outer surface and the surface adjacent to the PET film) are shown together in Table 1.

The baking was performed in an oven purged with nitrogen. The concentration of the swelling inhibitor was obtained by IR spectrophotometry of the diagonally cut DF for determining perfluoroalkyl groups in accordance with the above-described method.

Then, the DF was transferred onto the substrate 2 including the energy generating element 1 and having the supply port 3 by lamination while being heated at 70° C. (FIGS. 6B, 6C, and 3A). Since the outer surface of the DF was brought into contact with the substrate 2 by the lamination, the swelling inhibitor is distributed so that the concentration thereof gradually increases from the surface of the DF 10 adjacent to the substrate 2 to the surface opposite the substrate 2. Since the lamination was performed at a temperature as low as 70° C., the swelling inhibitor content was not varied in this step.

Subsequently, the DF 10 was exposed to light at an exposure dose of 9000 J/m$^2$ with an i-line exposure stepper through a mask 11 having a flow channel pattern. Furthermore, the DF 10 was subjected to PEB at 70° C. for 5 minutes to cure the exposed portion, thus forming a flow channel member 4 (FIG. 3B).

Then, a solution of photosensitive resin composition (2) was applied onto a 100 μm-thick PET film and baked at 80° C. for 5 minutes in the same manner as in the formation of the DF 10, thus forming a 10 μm-thick DF 12. The solution of photosensitive resin composition (2) contained the following material:

EHPE-3150 (produced by Daicel): 100 parts by mass

CPI-410 (produced by San-Apro): 2 parts by mass

A-187 (produced by Momentive Performance Materials): 5 parts by mass 1,4-HFAB (produced by Central Glass): 20 parts by mass propylene glycol monomethyl ether acetate: 120 parts by mass Since the baking for forming the DF 12 of photosensitive resin composition (2) was performed at 80° C. for 5 minutes, the swelling inhibitor was hardly evaporated from the coating of the solution of photosensitive resin composition (2) and the DF 12. The DF 12 was then transferred onto the DF 10 by lamination while being heated at 70° C. Subsequently, a liquid-repellent layer 9 containing a condensate of (tridecafluoro-1,1,2,2-tetrahydrooctyl) triethoxysilane, glycidoxypropyltrimethoxysilane, and methyltriethoxysilane was formed (FIG. 3C).

Subsequently, the DF 12 and the liquid-repellent layer 9 were exposed to light at an exposure dose of 600 J/m$^2$ with an i-line exposure stepper through a mask 13 having an ejection opening pattern. Furthermore, the exposed portions were cured by PEB at 90° C. for 5 minutes to form an ejection opening member 8 (FIG. 6D).

Then, the uncured portions of the DF 10, the DF 12, and the liquid-repellent layer 9 were removed with propylene glycol monomethyl ether acetate to form a flow channel 5, ejection openings 6, and ejection portions 7. Then, the resulting structure was heated at 200° C. for one hour to complete a liquid ejection head (FIG. 6E).

Since the swelling inhibitor is incorporated into the cross-linked network of the epoxy resin through the exposure and PEB, the concentration of the swelling inhibitor in the flow channel member 4 and the ejection opening member 8 is not varied by this heating.

In any Example according to the present disclosure, since the concentration of the swelling inhibitor on the substrate side of the flow channel member 4 is low, the adhesion of the flow channel member 4 with the substrate 2 can be high. In addition, since the concentration of the swelling inhibitor on the opposite side, adjacent to the ejection opening member 8, is high, the flow channel member can be hindered from swelling even in the case of using an ink containing organic solvent with a high proportion.

Comparative Examples 1 and 2

Liquid ejection heads were produced in the same manner as in Example 1 except the conditions shown in Table 2 were applied. In Comparative Example 1, a liquid ejection head including a flow channel member not containing a swelling inhibitor was produced. The flow channel member 4 of the liquid ejection head of Comparative Example 2 contained a large amount of a swelling inhibitor evenly throughout the member. The results are shown together in Table 2.

Comparative Example 3

In the liquid ejection head of Comparative Example 3, the concentration of the swelling inhibitor in the flow channel member was high on the substrate 2 side and low on the ejection opening member 8 side. The results are shown together in Table 3.

The liquid ejection head of this comparative example was produced according to the following procedure.

First, a solution of photosensitive resin composition (1) shown in Table 3 was applied onto a substrate 2 not having the supply port 3 to form a coating 10 of 15 μm in thickness by spin coating, and the coating was prebaked under the conditions shown in Table 3. Then, the flow channel 5, the ejection openings 6, and the ejection portions 7 were formed in the same manner as in the Examples. Finally, the supply port 3 was formed by dry etching to complete the liquid ejection head.

Evaluation

Each of the liquid ejection heads of the Examples and the Comparative Examples was mounted in an ink jet printer, and 30,000 sheets were printed with an ink having the following composition for evaluation. The ink contained:

2-pyrrolidone: 20 parts by mass;

1,2-hexanediol: 5 parts by mass;

ethylene glycol: 10 parts by mass;

a black pigment: 5 parts by mass;

acrylic resin for dispersion: 10 parts by mass; and water: 100 parts by mass.

Separation

The flow channel of the liquid ejection head was observed from the surface having the ejection openings under an optical microscope and checked for separation of the flow channel member 4 from the substrate 2.

No separation: A

Partial separation was observed, but did not affect ejection: B

Separation affecting ejection occurred: C

Variation in the Amount of Ejection

The variation in the amount of ejection with respect to the initial ejection was measured.

Variation was less than 5%: A

Variation was in the range of 5% to less than 10%: B

Variation was 10% or more: C

TABLE 1

| Example | Swelling inhibitor: Compound (Product name) | Swelling inhibitor: Amount (parts by mass) | DF heat treatment conditions: Temperature (° C.) | DF heat treatment conditions: Time (min) | Swelling inhibitor concentration in DF: Outer surface side (mass %) | Swelling inhibitor concentration in DF: Base side (mass %) | Evaluation results: Separation | Evaluation results: Variation in ejection amount |
|---|---|---|---|---|---|---|---|---|
| 1 | 1,4-HFAB | 40 | 90 | 20 | 11.7 | 29.9 | B | A |
| 2 | 1,4-HFAB | 30 | 90 | 20 | 9.5 | 25.0 | A | A |
| 3 | 1,4-HFAB | 25 | 90 | 20 | 7.2 | 21.1 | A | A |
| 4 | 1,4-HFAB | 20 | 90 | 20 | 5.8 | 13.5 | A | A |
| 5 | 1,4-HFAB | 15 | 90 | 20 | 6.6 | 11.1 | A | A |
| 6 | 1,4-HFAB | 10 | 90 | 20 | 5 | 7.7 | A | B |
| 7 | 1,4-HFAB | 30 | 115 | 20 | 3.3 | 23.7 | A | A |
| 8 | 1,4-HFAB | 25 | 115 | 20 | 3.1 | 20.1 | A | A |
| 9 | 1,4-HFAB | 20 | 115 | 20 | 2.1 | 15.0 | A | A |
| 10 | 1,4-HFAB | 15 | 115 | 20 | 2 | 10.1 | A | A |
| 11 | 1,4-HFAB | 30 | 140 | 20 | 0.9 | 21.5 | A | A |
| 12 | 1,4-HFAB | 25 | 140 | 20 | 0.9 | 18.8 | A | A |
| 13 | 1,4-HFAB | 20 | 140 | 20 | 0.9 | 13.1 | A | A |
| 14 | 1,4-HFAB | 15 | 140 | 20 | 0.5 | 9.3 | A | A |
| 15 | 1,3-HFAB | 30 | 90 | 20 | 4.2 | 20.1 | A | A |
| 16 | 1,3-HFAB | 15 | 90 | 20 | 2.9 | 13.5 | A | A |
| 17 | 1,3-HFAB | 30 | 140 | 20 | 0.1 | 15.2 | A | A |
| 18 | 1,3-HFAB | 15 | 140 | 20 | 0.1 | 10.5 | A | A |
| 19 | BIS-AF | 30 | 90 | 20 | 9.9 | 26.9 | A | A |
| 20 | BIS-AF | 15 | 90 | 20 | 7.5 | 14.5 | A | A |
| 21 | BIS-AF | 30 | 140 | 20 | 2.3 | 13.1 | A | A |
| 22 | BIS-AF | 15 | 140 | 20 | 1.5 | 11.2 | A | A |

TABLE 2

| Comparative Example | Swelling inhibitor: Compound (Product name) | Swelling inhibitor: Amount (parts by mass) | DF heat treatment conditions: Temperature (° C.) | DF heat treatment conditions: Time (min) | Swelling inhibitor concentration in DF: Outer surface side (mass %) | Swelling inhibitor concentration in DF: Base film side (mass %) | Evaluation results: Separation | Evaluation results: Variation in ejection amount |
|---|---|---|---|---|---|---|---|---|
| 1 | 1,4-HFAB | 0 | 90 | 20 | — | — | A | C |
| 2 | 1,4-HFAB | 30 | 50 | 20 | 30 | 30 | C | A |

TABLE 3

| Comparative Example | Comparative Example: Compound (Product name) | Comparative Example: Amount (parts by mass) | Swelling inhibitor: Temperature (° C.) | Swelling inhibitor: Time (min) | DF heat treatment conditions: Outer surface side (mass %) | DF heat treatment conditions: Base film side (mass %) | Swelling inhibitor concentration in DF: Separation | Swelling inhibitor concentration in DF: Variation in ejection amount |
|---|---|---|---|---|---|---|---|---|
| 3 | 1,4-HFAB | 30 | 115 | 20 | 23.4 | 3.5 | C | C |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-005896, filed Jan. 17, 2017 and No. 2017-220952, filed Nov. 16, 2017, which are hereby incorporated by reference herein in their entirety.

What is claimed is:

1. A liquid ejection head comprising:

a substrate including an energy generating element configured to generate energy used for ejecting a liquid;

a flow channel member overlying the substrate and defining a flow channel through which a liquid is supplied; and an ejection opening member overlying the flow channel member and defining an ejection opening through which the liquid supplied through the flow channel is ejected by the energy from the energy generating element, wherein the flow channel member contains a crosslinked cured product of a multifunctional epoxy resin and a polyhydric alcohol having a perfluoroalkyl group in the molecule thereof, and wherein the concentration of a component derived from the polyhydric alcohol in the flow channel member is lower on a side adjacent to the substrate than on the opposite side adjacent to the ejection opening member.

2. The liquid ejection head according to claim 1, wherein the polyhydric alcohol is at least one selected from the group consisting of 1,4-bis(2-hydroxyhexafluoroisopropyl)benzene, 1,3-bis(2-hydroxyhexafluoroisopropyl)benzene, and 2,2-bis(4-hydroxyhenyl)hexafluoropropyl.

3. The liquid ejection head according to claim 1, wherein the multifunctional epoxy resin is at least one selected from the group consisting of bisphenol A novolac epoxy resin, phenol novolac epoxy resin, cresol novolac epoxy resin, and trifunctional or higher functional epoxy resin having an oxycyclohexane skeleton.

4. The liquid ejection head according to claim 1, wherein the concentration of the component derived from the polyhydric alcohol in the flow channel member on the side adjacent to the substrate is in the range of 0.1% by mass to 20% by mass.

5. The liquid ejection head according to claim 1, wherein the concentration of the component derived from the polyhydric alcohol in the flow channel member on the side adjacent to the ejection opening member is in the range of 5% by mass to 30% by mass.

6. The liquid ejection head according to claim 1, wherein the concentration of the component derived from the polyhydric alcohol in the flow channel member decreases in a thickness direction of the flow channel member from the side adjacent to the ejection opening member to the side adjacent to the substrate.

7. The liquid ejection head according to claim 1, wherein the substrate is made of silicon.

8. The liquid ejection head according to claim 1, wherein the flow channel member is in direct contact with the substrate.

9. The liquid ejection head according to claim 1, wherein the flow channel defines a pressure chamber within which the energy generating element is located, and the liquid is circulated between an inside of the pressure chamber and the outside of the pressure chamber.

* * * * *